United States Patent [19]

Penney

[11] 4,121,312

[45] Oct. 24, 1978

[54] SWIM GLOVE

[76] Inventor: William Hayward Penney, 15 Putnam St., Revere, Mass. 02151

[21] Appl. No.: 765,878

[22] Filed: Feb. 7, 1977

[51] Int. Cl.[2] ..... A63B 31/02

[52] U.S. Cl. ..... 9/308

[58] Field of Search ..... 9/301, 307, 308; 2/168

[56] References Cited

U.S. PATENT DOCUMENTS

| | | | |
|---|---|---|---|
| 762,017 | 6/1904 | Ammon | 9/308 |
| 2,004,684 | 6/1935 | Bell | 9/308 |

FOREIGN PATENT DOCUMENTS

| | | | |
|---|---|---|---|
| 818,827 | 7/1949 | Fed. Rep. of Germany | 2/168 |
| 631,467 | 12/1927 | France | 9/308 |
| 1,476,696 | 4/1967 | France | 9/344 |

*Primary Examiner*—Trygve M. Blix
*Assistant Examiner*—Sherman D. Basinger
*Attorney, Agent, or Firm*—Robert D. Farkas

[57] ABSTRACT

A glove to be worn by a swimmer for use in aiding the swimming stroke; the glove includes webbed finger stalls, an embossed surface and an air floatation collar about the wrist area for buoyancy.

6 Claims, 4 Drawing Figures

SWIM GLOVE

BACKGROUND OF THE INVENTION

This invention relates to swim gloves; more particularly to a glove having webbed finger stalls, an embossed non-skid, non-slip surface and a floatation collar thereon.

The prior art teaches a variety of swim gloves and the like, for example, as disclosed in U.S. Pat. Nos. 1,049,448; 1,588,635; 1,669,010; 1,679,679; 1,773,440; 2,324,375; 2,726,410; 3,023,432; 3,257,673; and others.

SUMMARY OF THE INVENTION

It is accordingly an object of the instant invention to provide for a new and improved swim glove.

It is another object to provide for one having the aforementioned attributes.

It is a further object to provide for the same at relatively little cost thereby making it generally available.

These and other objects and advantages of the invention will become more apparent from a consideration of the following detailed disclosure and claims and by reference to the accompanying drawings, in which:

Figure 1:
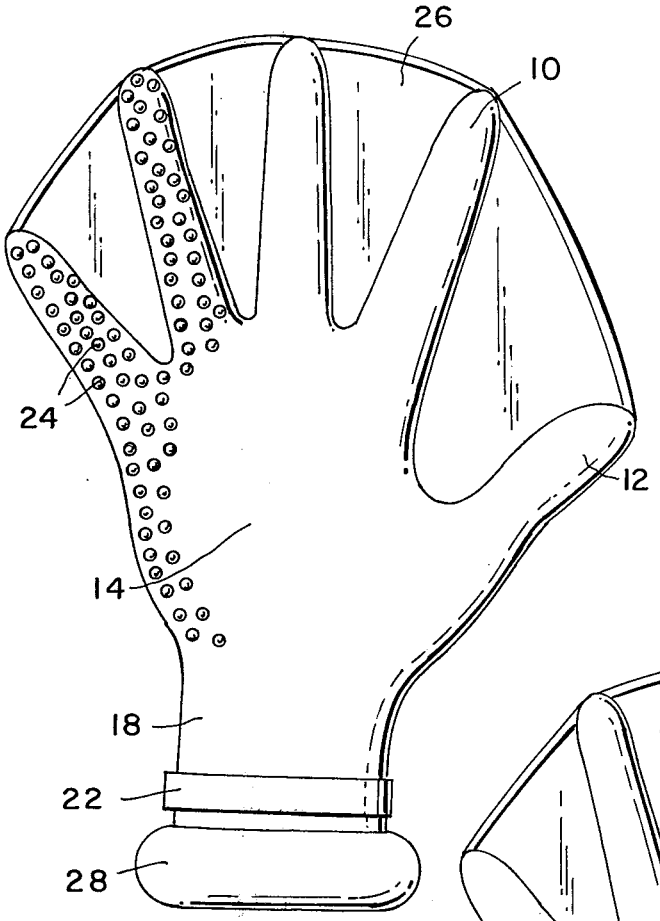
FIG. 1 is a top plan view.
Figure 3:
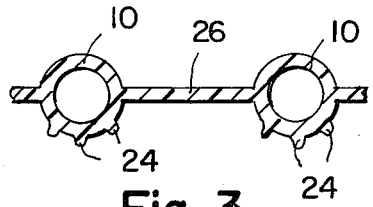
FIG. 3 is a sectional view taken along the line 3—3 of FIG. 2.
Figure 2:
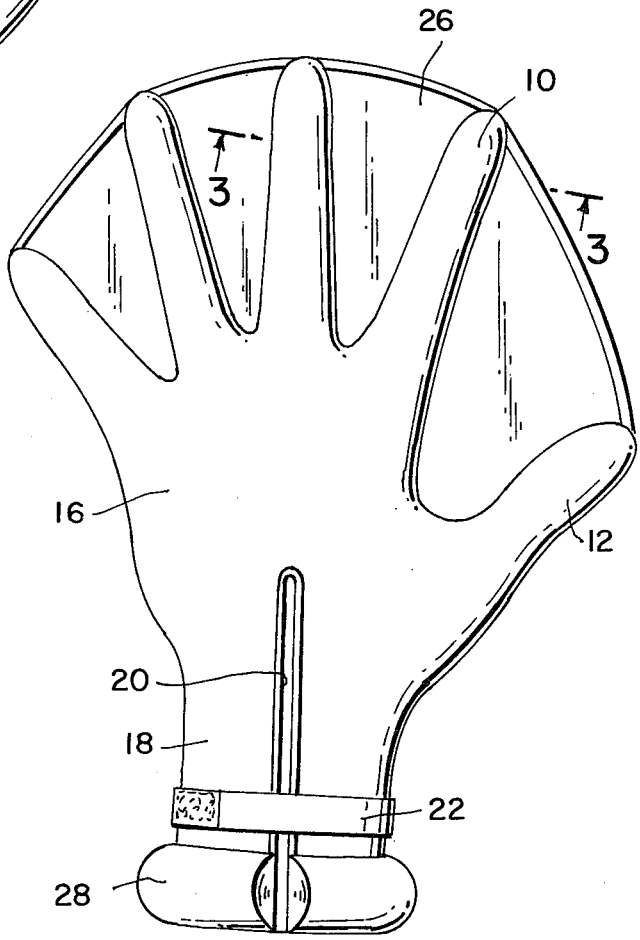
FIG. 2 is a bottom plan view.
Figure 4:
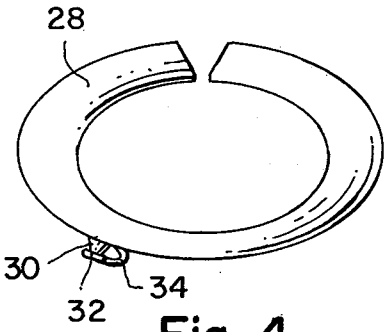
FIG. 4 is a perspective view of the collar portion of the glove.

Broadly speaking, the instant invention includes the provision of a glove for use in connection with swimming, comprising a glove body including a plurality of finger stalls and a thumb stall, a webbed portion communicating therebetween, a plurality of embossed heads on at least one side of the glove body, a hollow, walled collar disposed adjacent the open end of the body, the collar retaining a quantity of gas therein.

DETAILED DISCLOSURE

Referring more particularly to the drawings, there is shown a glove body which includes a plurality of finger stalls 10, a thumb stall 12, a front or bottom portion 14 covering the palm of the hand, a back or top portion 16 covering the back of the hand and an open end at the wrist area for slipping the hand therein. The portion 18 at the wrist area preferably extends above the wrist for a short distance. The back portion of the glove will preferably contain a slit 20 communicating with the open end to facilitate insertion of the hand thereinto. A closure means 22 will preferably be provided to facilitate maintaining the glove on the hand. The means 22 will bridge across the slit 20 which is in longitudinal alignment with the glove body. The means 22 may be a strap with a buckle, fasteners, snaps or a "Velcro" strip. The means 22 may be affixed to the glove body or be removable therefrom. At least the palm portion 14 of the glove body will include a plurality of embossed heads 24 thereon, such as heads of about one-sixteenth--five sixteenths in diameter and about one thirty-second-three thirty-seconds in height above the surface of the portion 14. These embossed heads 24 may be integrally bonded to the portion 14 or be unitary molded therewith. The glove body may be made of any suitable material that is preferably water impermeable, i.e., plastic, latex (natural or synthetic) or one of the non-woven materials. The embossed heads 24 should enjoy the same property. The heads 24 may be randomly or orderly disposed about the portion 14. The finger stalls 10 and thumb stall 12 are connected to each other by a webbed member 26 that is preferably resilient and flexible so that the stalls 10, 12 may be easily manipulated. A liquid impermeable material similar to that for the glove body should preferably be employed. An annular collar 28 that is formed of a hollow walled body is disposed adjacent the distal open end of the body thereby providing buoyancy for the body, since the same will contain and retain a quantity of air or other suitable lighter than water gas therein. The collar 28 is preferably split along the same line as the glove body to further facilitate insertion of the hand therein where the collar 28 is unitary with the glove body. Where it is not, the split need not be present. In the preferred embodiment, the collar 28 is split and also includes a spout portion 30 having an open-sealable end 32 functioning as a valve to provide means for filling the collar 28 with gas. An integral cap or cover portion 34 is provided to close the valve once the collar has been filled with gas, i.e., similar to that on a child's water tub or inflatable toy.

Since it is obvious that numerous changes and modifications can be made in the above-described details without departing from the spirit and nature of the invention, it is to be understood that all such changes and modifications are included within the scope of the invention.

I claim:

1. A glove for use in connection with swimming, comprising a glove body, said glove body having a plurality of finger stalls and a thumb stall, a plurality of flexible sheets, said plurality of flexible sheets fixedly secured to adjacent said finger stalls and to one of said finger stalls and said thumb stall, said plurality of flexible sheets disposed secured along the entire length of said plurality of finger stalls and the entire length of said thumb stall, a plurality of embossed heads, a portion of said plurality of embossed heads being disposed on at least one side of said glove body and adjacent the palm portion thereof, a hollow walled flotation collar, said flotation collar fixedly secured to said glove body adjacent an open hand receiving end thereof, means to inflate said collar with a gas and releasably contain said gas within said collar whereby said collar provides bouyancy for said glove body, and whereby said collar is disposed located adjacent the wrist portion of a user, wherein said glove body includes a slit therein, said slit being disposed extending substantially transverse to said hand receiving end of said glove body and communicating therewith, said slit being located on a side of said glove body opposite the location of said portion of said plurality of said embossed heads, wherein said flotation collar is split along a line, said line being aligned with said slit, means to secure portions of said glove body disposed adjacent the marginal edges of said slit together thereby securing said glove body about a portion of the wrist of a user.

2. The apparatus as claimed in claim 1 wherein said flotation collar is an annular ring, said annular ring having a portion thereof extending outwardly from the surface of said glove body disposed adjacent the location of said annular ring.

3. The apparatus as claimed in claim 1 wherein said means to inflate comprises said flotation collar having an aperture communicating to the interior hollow regions thereof, a closable valve, said closable valve fixedly secured to an exterior surface of said flotation collar surrounding the location of said aperture, whereby said collar is configured to be inflated upon the insertion of said gas into said collar by passing through said valve when said valve is in an opened condition, and whereby said collar is dimensioned so as to retain a sufficient quantity of said gas when said valve is in a closed condition providing a bouyancy force to said glove body when said glove body is disposed contacting a body of water.

4. The apparatus as claimed in claim 1 wherein the remaining portion of said plurality of heads are disposed on said plurality of finger stalls and said glove stall on the side of said glove body carrying said portion of said plurality of said heads.

5. The apparatus as claimed in claim 1 wherein said glove body and said plurality of sheets are constructed of a water impermeable material.

6. The apparatus as claimed in claim 1 wherein said glove body and said plurality of sheets are flexible.

* * * * *